US005799545A

United States Patent [19]

George

[11] Patent Number: 5,799,545

[45] Date of Patent: Sep. 1, 1998

[54] ERGONOMIC HAND WHEEL FOR RAILWAY CAR HAND BRAKE

[75] Inventor: Rudi E. George, Peotone, Ill.

[73] Assignee: Westinghouse Air Brake Company, Wilmerding, Pa.

[21] Appl. No.: 602,492

[22] Filed: Feb. 20, 1996

[51] Int. Cl.[6] ..... B62D 1/04

[52] U.S. Cl. ..... 74/552; 475/317

[58] Field of Search ..... 74/498, 10, 52, 74/552; 475/317, 331

[56] References Cited

U.S. PATENT DOCUMENTS

| | | | |
|---|---|---|---|
| 1,342,599 | 6/1920 | Sauvage | 74/552 X |
| 1,766,273 | 6/1930 | Wine | 74/507 |
| 2,282,736 | 5/1942 | Mersereau | 74/505 |
| 2,679,170 | 5/1954 | Prittie | 475/317 X |
| 3,258,991 | 7/1966 | Bezlaj . | |
| 3,456,528 | 7/1969 | Maruyama | 475/317 X |
| 4,282,771 | 8/1981 | Grube . | |
| 4,291,793 | 9/1981 | Klasing . | |
| 4,301,693 | 11/1981 | Stanley . | |
| 4,368,648 | 1/1983 | Housman et al. . | |
| 4,531,427 | 7/1985 | Nilsson | 74/498 X |
| 4,714,142 | 12/1987 | Sheperd . | |
| 5,127,283 | 7/1992 | O'Brien et al. . | |

*Primary Examiner*—Rodney H. Bonck
*Assistant Examiner*—Saul J. Rodriguez
*Attorney, Agent, or Firm*—James Ray & Associates

[57] ABSTRACT

An ergonomic hand wheel for use on a hand brake system on a railway car in which a hand wheel includes a planetary gear system to provides a mechanical advantage to significantly reduce the effort and force required to turn the hand wheel. The planetary gear system includes a sun gear rigidly interconnected to the hand wheel and a hub member rotatably interconnected to the hand wheel which is independently rotatable relative to the hand wheel. The hub member further including a socket at the axis for attaching the hub member to a rotatable drive member of a hand brake system on a railway car, as well as a plurality of planetary gears rotatably secured thereto to mesh with and engage the sun gear. A fixed ring gear attached to a structural element independent of the hand wheel and the hub member, encircles, meshes with and engages the planetary gears.

18 Claims, 7 Drawing Sheets

ERGONOMIC HAND WHEEL FOR RAILWAY CAR HAND BRAKE

FIELD OF THE INVENTION

The present invention relates, in general, to hand braking apparatus for railway cars and, more particularly, this invention relates to a new and unique ergonomic hand wheel assembly for use on a railway car having a conventional type hand brake system which provides a mechanical advantage that will enable a significant reduction in the effort or force that is required to turn the hand wheel while at the same time there is maintained a comparable resultant turning force at the hand wheel hub so that, for example, the input turning force at the hand wheel rim may be reduced from about 125 pounds to about 50 pounds.

BACKGROUND OF THE INVENTION

Usually, as is generally well known in the railway industry, when railway cars are taken out of a train and parked at a siding or yard, the hand brakes on at least some of these cars are applied as a precaution against unwanted or unexpected movement of the cars. A typical railway car hand brake normally consists of apparatus for manually applying a brake shoe or shoes against one or more wheels of the railway car by either turning a hand wheel or pumping a ratchet handle connected by gears and/or linkage to the brake shoe engaging mechanism. It is, of course, essential that the apparatus include a mechanism for releasing the hand brake and causing the brake shoe or shoes to be disengaged from contact with the wheels.

Normally, either a cast or stamped metal gear housing is attached on an outside wall portion of the railway car adjacent one end thereof. Such gear housing having a rotatable shaft or drum therein to which is attached one end of an elongated brake chain. The hand wheel or ratchet handle assembly is interconnected through gears, as necessary, to cause rotation of the shaft or drum during an application of such hand brake. The brake chain extends through the bottom portion of the gear housing with the lower, opposite end thereof attached to a suitable brake linkage, so that manually turning of the hand wheel in a given predetermined direction (normally clockwise), or pumping the ratchet handle, will cause the uppermost end of the brake chain to be wound onto the shaft or chain drum, thereby drawing the brake chain tight and applying the brake shoe or shoes against a wheel or wheels through the brake linkage.

Although turning the hand wheel in the opposite direction will normally operate to release the hand brake in proportion to the extent of such turning, many such brake housings are provided with a quick release, non-spin mechanism which can be utilized to instantly and completely release such a hand brake without causing the hand wheel or ratchet handle to spin.

In the case of conventional freight cars, the gear housing is most commonly attached to an outer end wall of the railroad car adjacent to an end ladder, so that to turn the hand wheel or operate the ratchet handle to apply the hand brake, the brakeperson must normally climb at least a portion of the end ladder to reach the hand wheel or ratchet handle, and then turn the hand wheel or pump the ratchet handle with one hand while hanging on to the ladder with the other hand.

Even though some hand wheels or ratchet handles may be low enough that they can readily be reached by a brakeperson without climbing onto the ladder, it may still be advisable for safety reasons for the brakeperson to operate the hand brake from the ladder in the event the railway car is in motion or can be put into motion, to thereby minimize the risk of being struck by such a car in motion.

Specifications of the American Association of Railroads (AAR) currently require that a hand brake system disposed on a railway freight car have a minimum force requirement of at least 125 pounds to suitably set the hand brake. Accordingly, the gear arrangement within the various prior art gear housings are normally designed such that a 125 pound force on the hand wheel rim is required in order to set the hand brake.

For heavier freight cars where an increased force may be advisable, the common practice has been to utilize conventional gear housings and systems but to substitute a hand wheel of larger diameter so that a greater moment is effected thereby permitting the same turning force at the hand wheel to effect a greater resultant force at the hand wheel hub. A necessary force of at least about 125 pounds on the hand wheel, however, can be rather strenuous particularly if a brakeperson must apply the hand brake with one hand while holding onto the railway car with the other hand.

SUMMARY OF THE INVENTION

This invention is predicated on my conception and development of a new and unique ergonomic hand wheel having a planetary gear system built directly into the hand wheel itself which provides a mechanical advantage in that it permits a reduced input force at the rim of the hand wheel for effecting the same output force at the hub of the hand wheel. In essence, the inventive hand wheel is addressed to a new and unique ergonomic hand wheel which can be attached to virtually any currently existing hand brake system which, by virtue of the ergonomic mechanical advantage provided by the internal planetary gear arrangement, will render it much easier for a brakeperson to turn the hand wheel for purposes of applying the hand brake to thereby render the hand wheel turning operation not only easier but also significantly safer.

In summary, and in its broadest sense, the inventive ergonomic hand wheel of this invention includes a manually operable, hand wheel disk member adapted for manual rotation about an axis of rotation, as in the case of any conventional hand wheel. The new and unique planetary gear arrangement has a sun gear rigidly interconnected to the hand wheel disk member, with the axis of the sun gear corresponding with the axis of rotation of the hand wheel disk member. A hub member, also having a rotational axis aligned with the axis of rotation of the hand wheel disk member, is interconnected to the hand wheel disk member such that the hub member is independently rotatable relative to the hand wheel disk member about the same axis of rotation, with a means disposed on its back side at the axis of rotation, for attaching the hub member to a conventional rotatable drive shaft or drive member of the hand brake system on the railway car. A plurality of planetary gears are rotatably attached to the hub member which are positioned to encircle the sun gear and adapted to mesh with and engage the sun gear, while a stationary ring gear is disposed around the plurality of planetary gears, meshing and engaging the planetary gears, such that rotation of the hand wheel disk member, and accordingly rotation of the sun gear through a given rotational arc, will cause rotation of the planetary gears such that the planetary gears are, in essence, caused to roll between the rotating sun gear and the stationary ring gear, thereby imparting orbital motion to the rotating planetary gears as well as the hub member to which the planetary gears are attached. The orbital rotation of the planetary gears and hub member will revolve through an orbital arc less than the rotational arc traveled by the sun gear, to thereby provide a mechanical advantage.

In a more specific sense, a presently preferred embodiment of the inventive ergonomic hand wheel of this invention includes three basic components; namely a front housing assembly joined to a back housing assembly with a stationary internal gear housing assembly joined therebetween. The front housing assembly includes a stationary front housing disk to which a sun gear mounting plate is rotatably attached. A sun gear, as well as a hand wheel disk member, are rigidly attached to the rotatable sun gear mounting plate, such that the sun gear is rotatable upon manual rotation of the hand wheel disk member. The back housing assembly includes a stationary back housing disk to which the hub member is rotatably attached. The rotatable hub member includes means disposed on the back side at the axial center thereof for attaching the hub member to a hand brake drive shaft of a hand brake system on a railway car. Also included on the hub member is a plurality of gear axles which are attached to the rotatable hub member in an aligned, parallel and equally spaced relationship relative to the axial center. A planetary gear is rotatably mounted onto each gear axle such that the planetary gears will lie in the plane of the sun gear and each will mesh with and engage the sun gear, such that rotation of the sun gear will cause rotation of the planetary gears. The stationary internal gear assembly includes a means for attaching the assembly to an independent structural element for the purpose of maintaining the assembly stationary relative to the rotatable components of the front and back housing assemblies, as well as a stationary ring gear having a gear race on the inside surface adapted to encircle, engage and mesh with the plurality of planetary gears. Accordingly, any manual rotation of the hand wheel disk member will cause a like rotation of the sun gear, and accordingly, a reactive rotation of the planetary gears meshed with the sun gear. However, since the planetary gears are also meshed with the stationary ring gear, the rotating planetary gears will in essence be caused to roll along the internal gear race of the ring gear, thereby imparting an orbital rotation to the planetary gears as well as the gear axles on which they are mounted about the rotating sun gear. Since the gear axles are put into an orbital rotation, that rotation is imparted to the rotational hub member of the back housing assembly, through a rotational arc which is less than the rotational arc of the sun gear and the hand wheel disk member.

OBJECTS OF THE INVENTION

It is, therefore, one of the primary objects of the present invention to provide an ergonomic hand wheel assembly for a hand brake system disposed on a railway freight car which has a means incorporated therein to provide a mechanical turning advantage to significantly reduce the effort or force normally required to turn the hand wheel and thereby apply the hand brake.

Another object of the present invention is to provide an ergonomic hand wheel assembly for a hand brake system disposed on a railway car which is substantially easier for a brakeperson to turn for purposes of applying the railway car's hand brake.

A further object of the present invention is to provide an ergonomic hand wheel for a hand brake system on a railway car which not only requires less effort to turn but, also, can easily be turned with one hand.

Still another object of the present invention is to provide an ergonomic hand wheel for a hand brake system on a railway car which requires less effort to turn and can readily be attached to any existing hand brake system on a railway car without any significant retrofitting effort.

An additional object of the present invention is to provide an ergonomic hand wheel for a hand brake system on a railway car which requires less effort to turn and, therefore, provides a number of safety advantages as compared to a hand wheel of the prior art.

Yet still another object of the present invention is to provide an ergonomic hand wheel for a hand brake system on a railway car which can reduce the input turning force at the hand wheel rim from a typical 125 pounds to about 50 pounds.

In addition to the various objects and advantages of the invention described above, a number of additional objects and advantages of the ergonomic hand wheel of the present invention will become more readily apparent to those persons skilled in the railway braking art from the following more detailed description of the invention, particularly, when such description is taken in conjunction with the attached drawings and the appended claims.

DESCRIPTION OF THE PREFERRED EMBODIMENT OF THE INVENTION

Figure 1:
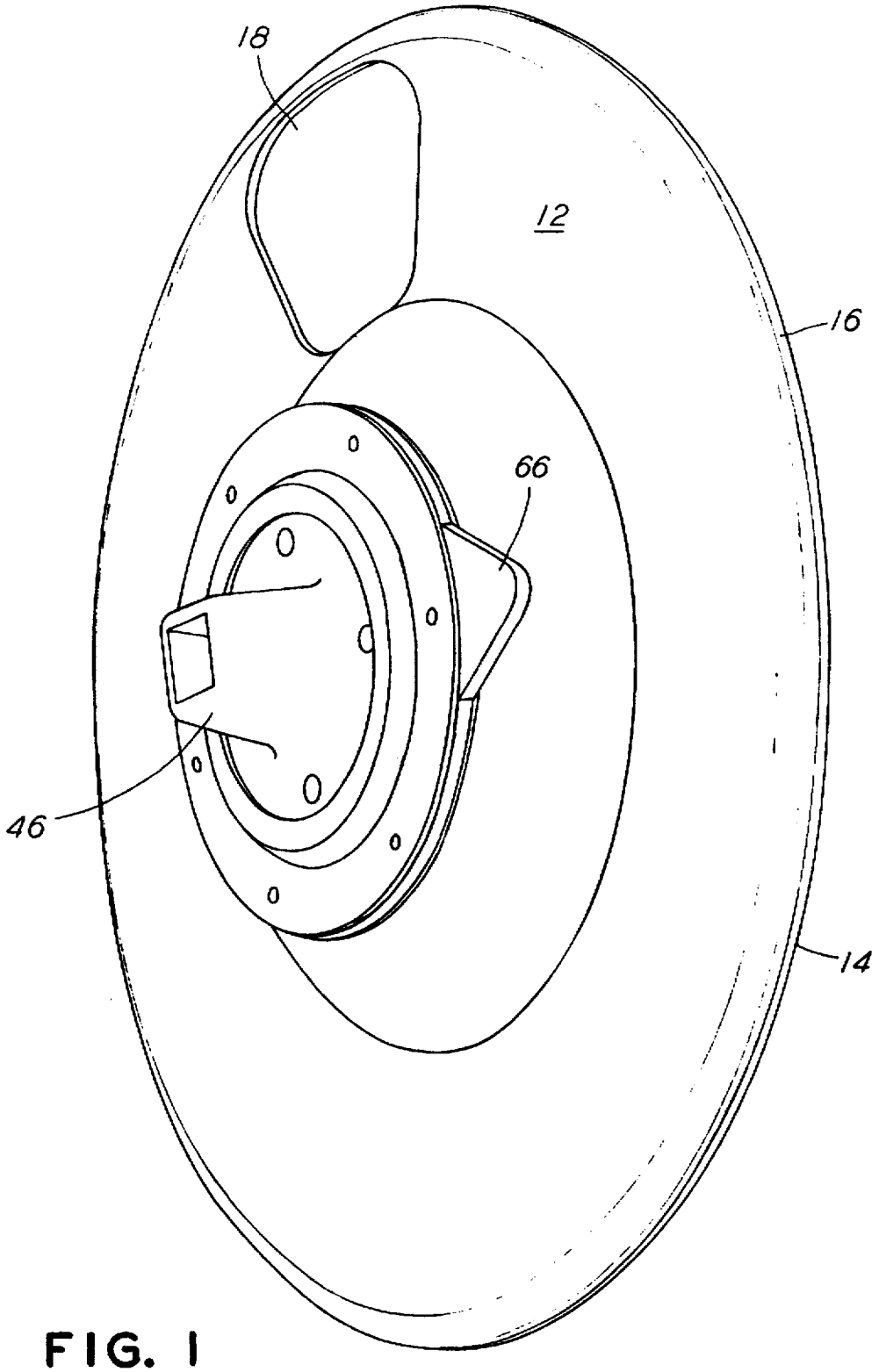
FIG. 1 is an isometric view of a hand wheel in accordance with a presently preferred embodiment of this invention viewing the back-side if the inventive hand wheel.

Prior to proceeding with the more detailed description of the present invention, it should be noted that for the sake of clarity, identical components which have identical functions have been identified with identical reference numerals throughout the several views illustrated in the attached drawing figures.

Figure 2:
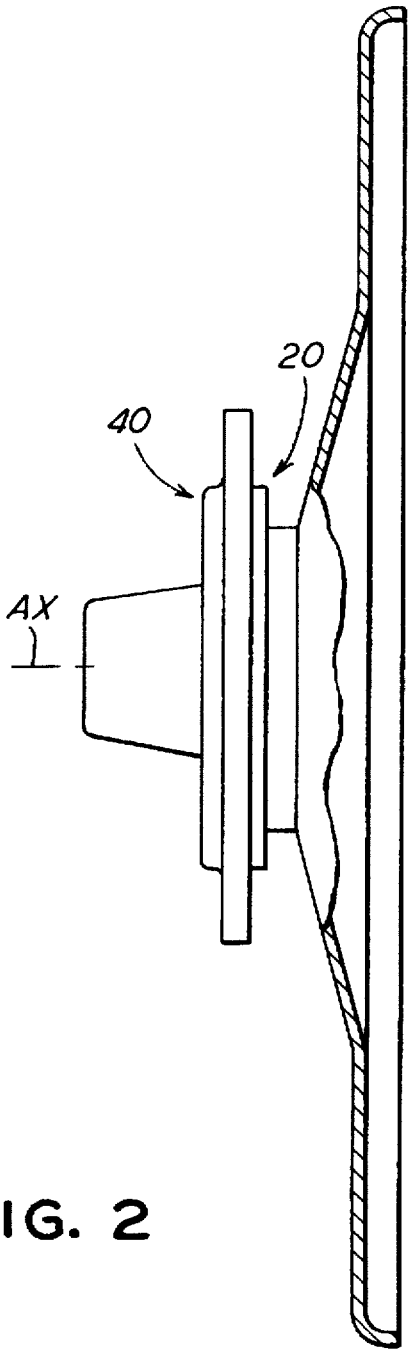
FIG. 2 is a cross-sectional side view of the hand wheel shown in FIG. 1 with the section taken through the axial center of the hand wheel; i.e., the axis of rotation.
Figure 3:
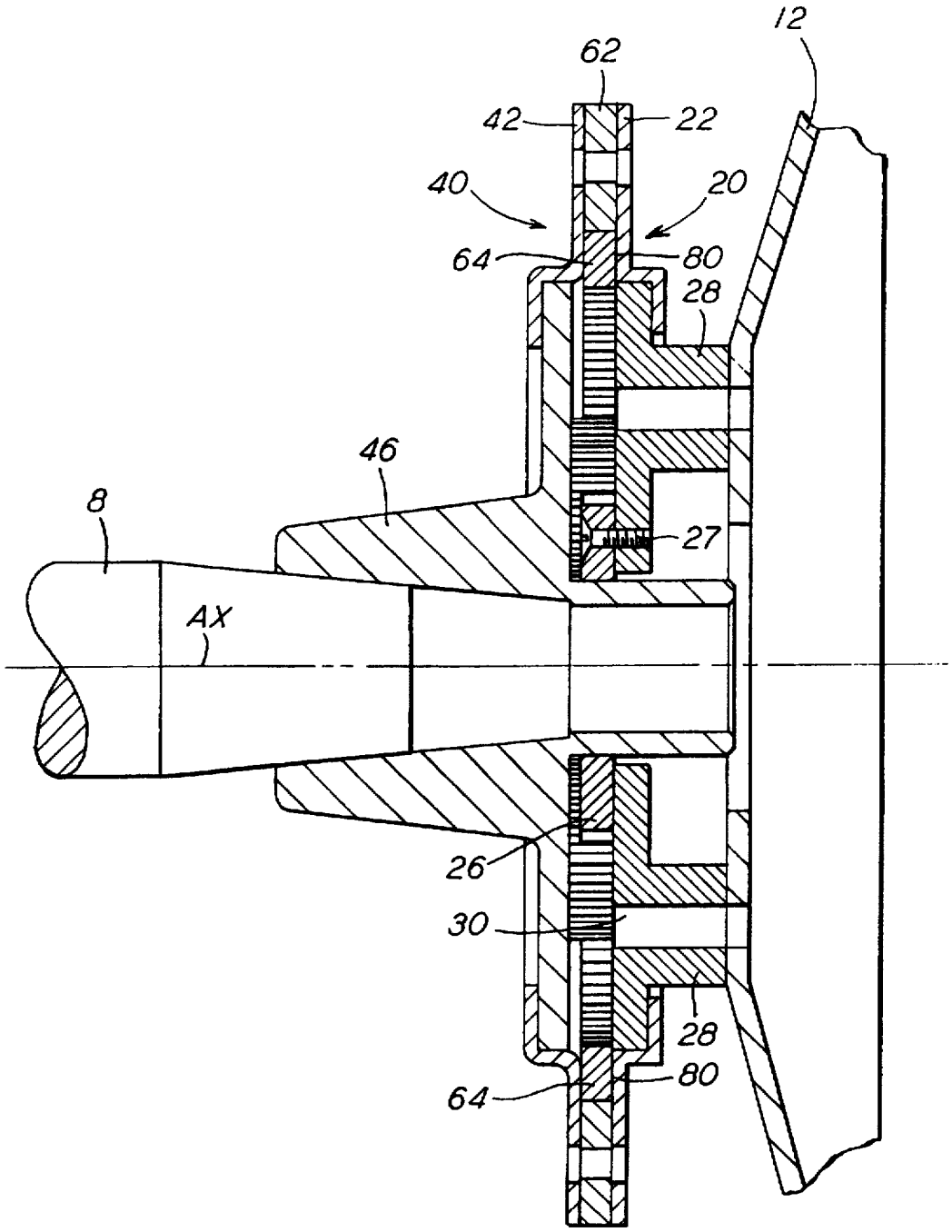
FIG. 3 is essentially the same as FIG. 2 except that it is enlarged to better illustrate the gear arrangement.

Now reference is made, more particularly, to FIGS. 1–3 which illustrate a presently preferred embodiment of this invention. As shown, the inventive ergonomic hand wheel, generally designated 10, essentially comprises a hand manipulation member, such as a hand wheel disk member 12 having a circular outer perimeter 14 adapted for manual manipulation around an axis of rotation AX.

The embodiment illustrated shows such hand wheel disk member 12 having a beveled peripheral flange 16. Adjacent to the beveled peripheral flange 16 and spaced away from the axis of rotation AX, the hand wheel disk member 12 can be of any desired form designed for easy manipulation, including that of a ratcheted lever arm, as will be described hereinafter.

Figure 4:
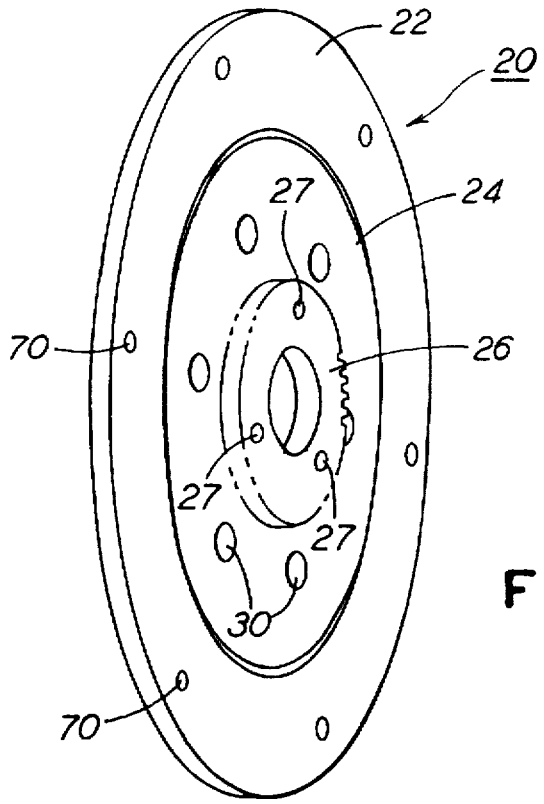
FIG. 4 is an isometric view of the front housing assembly showing the sun gear secured to a rotatable sun gear mounting plate.
Figure 5:
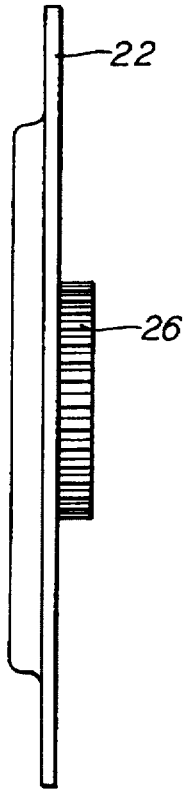
FIG. 5 is a side view of the front housing assembly shown in FIG. 4.

The hand wheel disk member 12 is interconnected to a front housing assembly 20. Specifically, the front housing assembly 20 (FIGS. 4 and 5) comprises a generally stationary front housing disk 22, having a sun gear mounting plate 24 rotatably attached thereto with the hand wheel disk member 12 directly or indirectly attached to the sun gear mounting plate 24. A sun gear 26 is also secured to such sun gear mounting plate 24, for example, with a plurality of bolts 27, while a spacer member 28 is also attached to such sun gear mounting plate 24 (FIGS. 2 and 3) at holes 30 (FIG. 4). The hand wheel disk member 12 is accordingly attached to the spacer member 28, such that rotation of hand wheel disk 12 will cause rotation of sun gear mounting plate 24 within such front housing disk 22, and of course, a like rotation of sun gear 26.

Sun gear mounting plate 24 and sun gear 26 are each circular in configuration, with each having an axial center that is aligned with the axis of rotation AX of such hand wheel disk member 12, so that manual rotation of hand wheel disk member 12 will cause the sum gear assembly, namely sun gear mounting plate 24 and sun gear 26 to rotate on their axial centers, which correspond with the axis of rotation AX.

Regardless of any variation in the interconnecting members, the primary objective for the front housing assembly 20 is to permit manual rotation of the hand wheel disk member 12 as necessary to impart an identical rotation of the sun gear 26.

Figure 7:
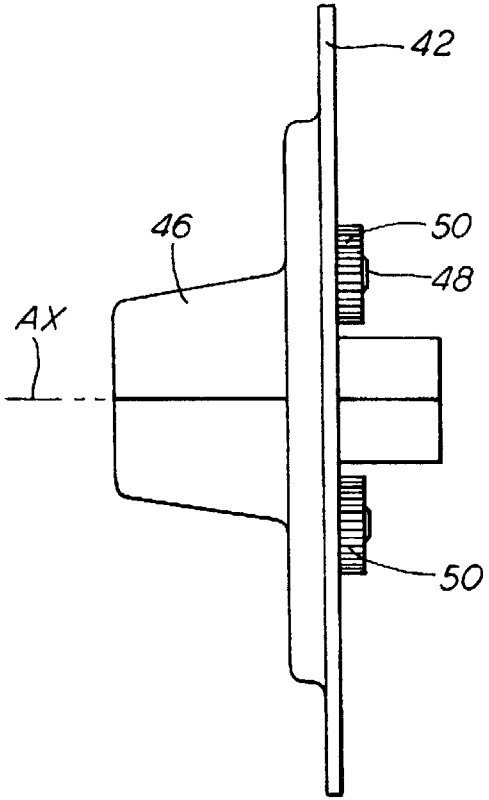
FIG. 7 is a side view of the back housing assembly shown in FIG. 6.
Figure 6:
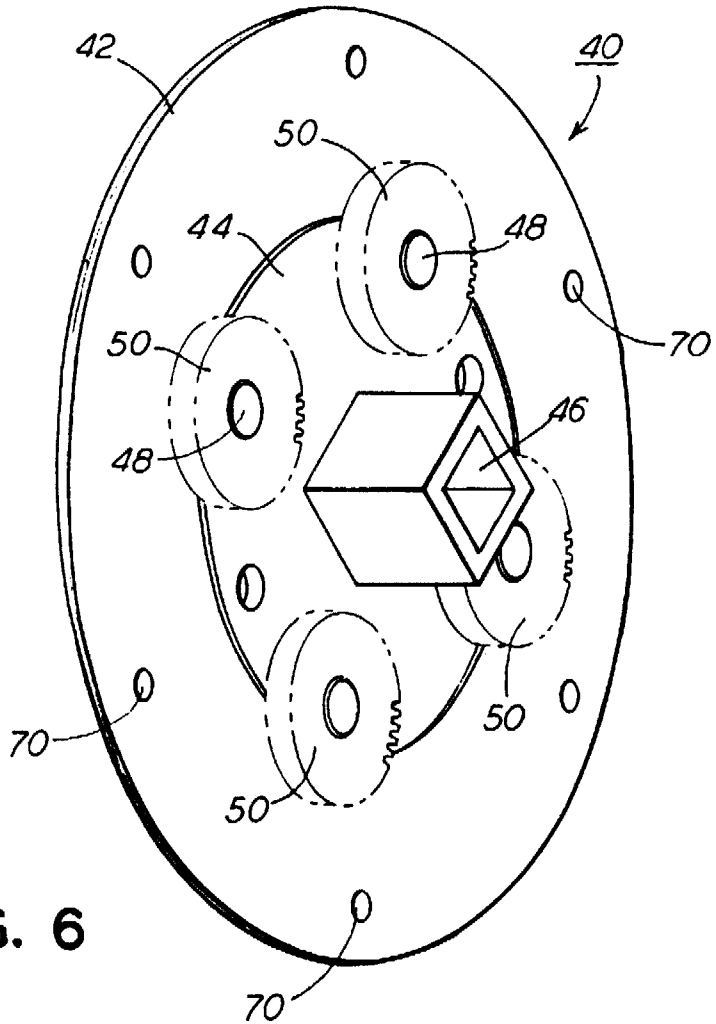
FIG. 6 is an isometric view of the back housing assembly showing the planetary gears rotatably attached to a rotatable hub member.

A back housing assembly 40, illustrated in FIGS. 6 and 7, comprises a generally stationary back housing disk 42, having a hub member 44 rotatably attached thereto. A means, such as socket 46, extends from back side of hub member 44 which is essentially provided for attaching the ergonomic hand wheel 10 onto a drive member 8 of a hand brake system on a railway car (not shown). The front side of such rotatable hub member 44 is provided with a plurality of parallel gear axles 48, which perpendicularly extend from hub member 44 and are substantially uniformly spaced around an axial center thereof, and a planetary gear 50 is rotatably mounted onto each gear axle 48.

The arrangement of the gear axles 48 and sizes of the planetary gears 50 must be such that the planetary gears 50 will lie in the plane of the sun gear 26, to thereby engage and mesh with the sun gear 26, so that rotation of the sun gear 26 will cause a uniform reaction rotation of the planetary gears 50, rotating on gear axles 48.

Figure 8:
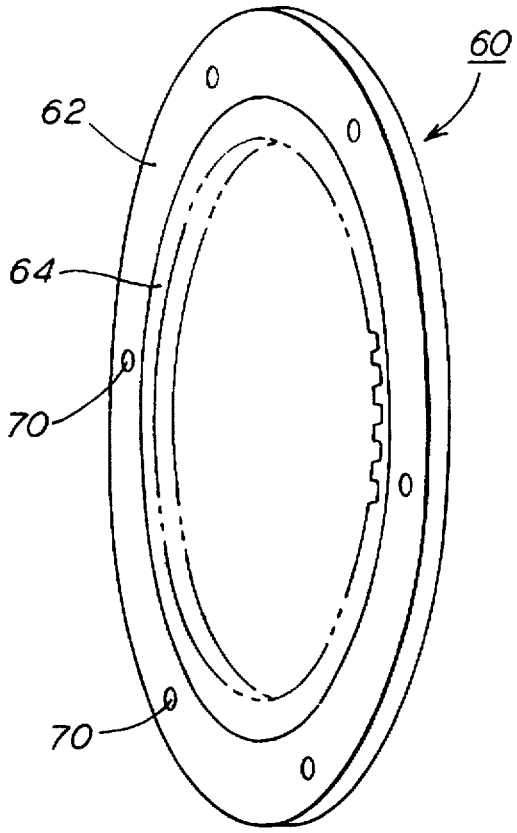
FIG. 8 is an isometric view of the internal gear housing showing the ring gear rigidly attached to a ring gear mounting plate.
Figure 9:
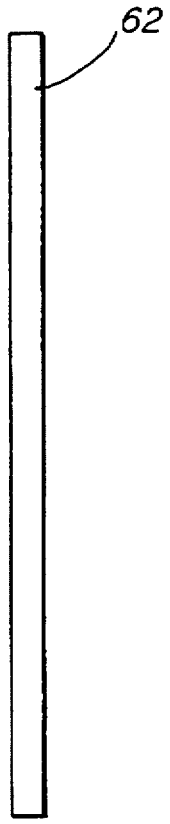
FIG. 9 is a side view of the internal gear housing shown in FIG. 8.
Figure 10:
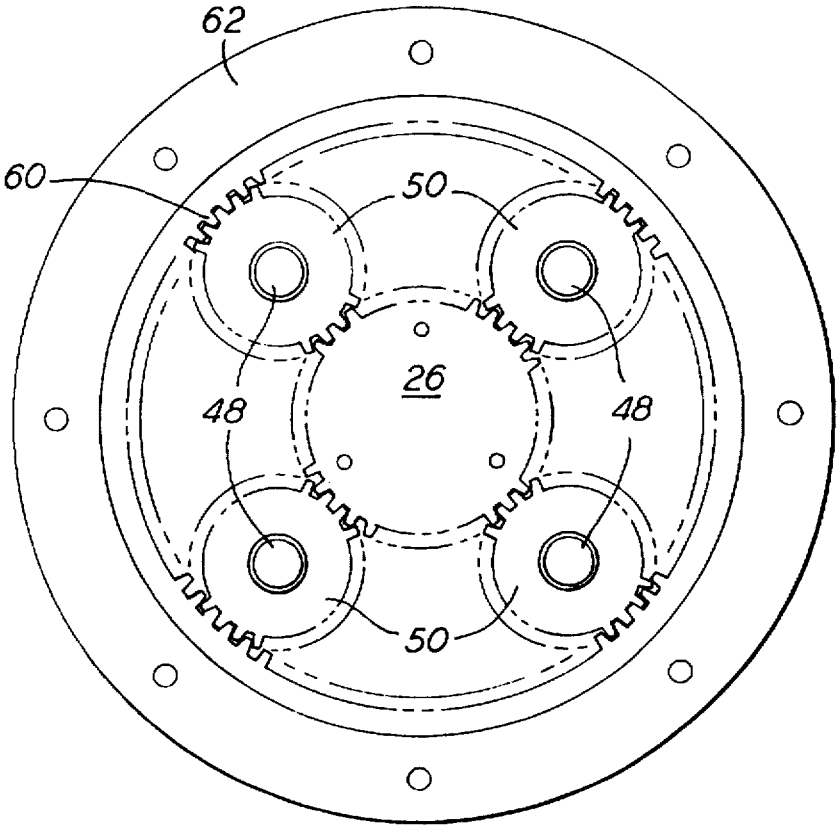
FIG. 10 is a plan view showing the arrangement of the various gears when the hand wheel is properly joined together in a completed condition.

An internal housing assembly 60, as illustrated in FIGS. 8 and 9, comprises a generally stationary internal housing disk 62, having a ring gear 64 rigidly attached thereto. Ring gear 64 is provided with a gear race on the circular inside surface which is adapted to encircle all of the planetary gears 50, and to engage and mesh with the planetary gears 50, such that rotation of the planetary gears 50 will necessarily cause them to roll along the stationary gear race on ring gear 64.

In addition to the above, a means is provided on the internal housing assembly 60, such as a flange 66, (FIGS. I and II) which serves the purpose of providing a means for securing the internal housing assembly 60 to an external structural element to thereby prevent rotation of internal housing disk 62 and ring gear 64 rigidly attached thereto, regardless of any rotation of either the sun gear mounting plate 24 or the hub member 44.

The front housing assembly 20 is joined to the back housing assembly 40, with the internal housing assembly 60 sandwitched therebetween. As can be seen in the drawings, a plurality of equally spaced holes 70 are provided through the faces of such front housing disk 22, the back housing disk 42, and such internal housing disk 62, which must be aligned and through which bolts (not shown) are inserted for purpose of joining the three assemblies together as above described.

While FIGS. 4–9 illustrate one each independent stationary front housing disk 22, stationary back housing disk 42 and stationary internal housing disk 62, these can be individual disks as shown, and bolted together as noted above, or can in fact comprise just a single disk or a pair of disks provided that sun gear 26 is rotatable with respect to any such disk or group of disks, and that the hub member 44, with the planetary gear axles 48 is also rotatable with respect to any such disk or group of disks, as well as being independently rotatable with respect to the sun gear 26.

When properly joined together, as described above, it should be apparent that with any manual rotation of such hand wheel disk member 12 it will cause sun gear 26 to rotate equally therewith, and that rotation of such sun gear 26 will cause the planetary gears 50 to reactively rotate on gear axles 48. Since ring gear 64 is stationary, however, and meshes with the plurality of planetary gears 50, it is apparent that as the planetary gears 50 rotate on gear axles 48, they will be caused to roll along the inner gear race of ring gear 64. This will cause the planetary gears 50 and the gear axles 48 to orbitally rotate about the sun gear 26, with an identical orbital rotation of such hub member 44, to which gear axles 48 are attached.

It should be further apparent, that the rotation of planetary gears 50 on gear axles 48 will, in essence, cause them to roll between rotating sun gear 26 and stationary ring gear 64, such that gear axles 48, in essence, will orbit midway between the rotating sun gear 26 and the stationary ring gear 64. It should be apparent that some orbital rotation will be imparted to the rotatable hub member 44, to which the gear axles 48 are attached.

It should be further apparent, however, that the extent of angular rotation and the angular rate of the hub member 44 will be somewhat less than the extent of angular rotation and angular rate of sun gear 26, which is, of course, responsible for the mechanical advantage created by the inventive ergonomic hand wheel. The degree of such mechanical advantage will, of course, depend upon the comparative radii of the sun gear 26 and the pitch diameter of the planetary gears 50 should be substantially equal to the radius of ring gear 64.

In an experimental model of this invention, utilizing a sun gear having a radius of 1.33 inches, and planetary gears having a radius of 0.83 inch, a mechanical advantage of 3.25:1 is achieved.

Because the ergonomic hand wheel assembly of this invention is significantly easier for a brakeperson to turn, and the resultant turning force at the hub will significantly exceed manual turning force at the hand wheel disk rim, it is desirable to provide a means for preventing an over application of the brake applying force which could damage the system or apply the hand brake so tightly that a conventional quick release mechanism will not function.

One presently preferred means for preventing such an over application of the hand brake within the embodiment illustrated herein includes a more or less conventional torque limiting device, comprising a thermoset laminate and wave spring 80 disposed between the ring gear 64 and any stationary element intended to retain the ring gear 64 in a stationary position.

As shown in both FIGS. 2 and 3, such a torque limiting device, comprising a thermoset laminate and wave spring 80 is sandwitched between the forward face of ring gear 64 and front housing disk 22. In this particular arrangement, front housing disk 22 and back housing disk 42 are bolted together through apertures 70 either with or without an internal housing disk 62.

In this particular embodiment, the stationary position of ring gear 64 is maintained by the frictional compressive force at the interface between ring gear 64 and front housing disk 22 and such that ring gear 64 is otherwise rotatable relative to internal housing disk 62 and back housing disk 42. In this particular embodiment, the thermoset laminate and wave spring 80 are annular in shape so that they can be positioned between the ring gear 64 and front housing disk 22, such that the frictional interface contact is the only force keeping ring gear 64 in a stationary position with front housing disk 22, back housing disk 42 and an internal housing disk 62, if utilized.

The combined thermoset laminate and wave spring are accordingly designed so that when a predetermined "brake-away" torque is achieved, the frictional force will be overcome, thereby allowing ring gear 64 to orbit with planetary gears 50. By achieving such a brake-away and permitting ring gear 64 to rotate with planetary gears 50, it should be apparent to persons skilled in the art that the ring gear 64, as well as planetary gears 50, will be caused to rotate in situ, so that no orbital rotation is imparted to the gear axles 48 or hub member 44.

Figure 11:
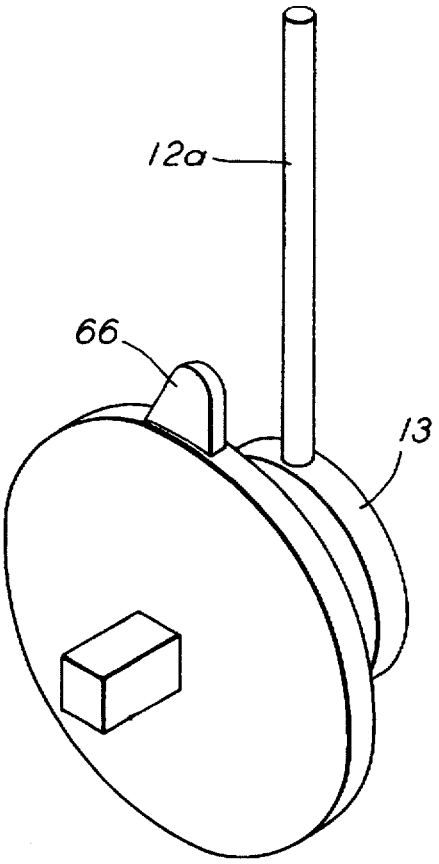
FIG. 11 in an isometric view of another presently preferred embodiment of the invention substantially like that shown in FIG. 1, except that a ratcheted lever arm is utilized in place of a hand wheel.

As noted above and as an alternative embodiment, for example, the hand wheel 12 could be fabricated in practically any desired form. In this regard, it should be further apparent that a lever arm 12*a*, with or without a conventional ratchet mechanism 13, could be substituted for the hand wheel disk member 12, as illustrated in FIG. 11. In this embodiment, no particular modifications would have to be made other that adapting the lever arm 12*a* to effectively rotate the sun gear 26 substantially as described above. In addition, and as noted in the specification, the means for housing the various gear elements and rotatable elements could take a variety of different forms, with or without one or more stationary disk member as illustrated.

In view of the above detailed description of the inventive ergonomic hand wheel of this invention, it should be apparent that numerous modifications could be made and differing embodiments utilized, without departing from either the spirit of the invention or the scope of the appended claims.

I claim:

1. An ergonomic hand wheel assembly for use on a hand brake system disposed on a railway car, said ergonomic hand wheel assembly comprising:

(a) a front housing assembly including;

(i) a generally concave front housing disk having a peripheral flange, (ii) a rotatable sun gear adjacent a concave inside surface of said generally concave front housing disk, and (ii) a hand manipulation member adjacent an outer surface of said generally concave front housing disk rigidly connected to said sun gear such that rotation of said hand manipulation member relative to said front housing disk will cause an equal rotation of said sun gear about an axis of rotation;

(b) a back housing assembly including;

(i) a generally concave back housing disk having a peripheral flange, (ii) a rotatable hub member adjacent a concave inside surface of said generally concave back housing disk having an axis of rotation aligned with said axis of rotation of said sun gear and said hand manipulation member, and such that said rotatable hub member is independently rotatable relative to said hand manipulation member and said sun gear about said axis of rotation, said hub member having a means extending through said generally concave back housing disk disposed at said axis of rotation for attaching said hub member to a rotatable hand brake drive shaft of such hand brake system disposed on such railway car; and (iii) a plurality of planetary gears, one each of said plurality of planetary gears rotatably mounted onto one of a plurality of gear axles, said gear axles attached to said hub member and aligned, parallel and substantially equally spaced from said axis of rotation such that said planetary gears lie in a single plane and are substantially uniformly spaced around said sun gear, and adapted to mesh with and engage said sun gear such that rotation of said sun gear will cause rotation of said planetary gears on said gear axles;

(c) a stationary and generally flat internal housing disk including;

(i) a ring gear rigidly and axially secured therein, said ring gear having a circular race on an inside surface thereof adapted to encircle, engage and mesh with said plurality of planetary gears, and (ii) means extending from a periphery of said internal housing disk for attaching said internal housing disk to a structural element independent of said hand manipulation member and said hub member, such that said hand manipulation member and said hub member are independently rotatable relative to said internal housing disk; and (d) means for rigidly joining said generally concave front housing disk to said generally concave back housing disk at their peripheral flanges such that said generally flat internal housing disk is sandwitched therebetween.

2. An ergonomic hand wheel assembly for use on a hand brake system disposed on a railway car, according to claim 1, in which said hand manipulation member comprises a hand wheel adapted for manual turning about said axis of rotation.

3. An ergonomic hand wheel assembly for use on a hand brake system disposed on a railway car, according to claim 1, in which said hand manipulation member comprises an elongated lever arm manually pivotal about said axis of rotation.

4. An ergonomic hand wheel assembly for use on a hand brake system disposed on a railway car, according to claim 3, in which said elongated lever arm includes a ratchet means sufficient to cause rotation of said sun gear assembly as a result of a reciprocal pumping action applied to said elongated lever arm.

5. An ergonomic hand wheel assembly for use on a hand brake system disposed on a railway car, according to claim 1, in which each of said planetary gears are rotatably mounted onto an individual gear axle, and said each individual gear axle is attached to said hub member so as to place them in positions which are aligned, parallel and substantially equally spaced from said axis of rotation.

6. An ergonomic hand wheel assembly for use on a hand brake system disposed on a railway car, according to claim 1, in which a brake-away means is provided between said ring gear and said sun gear sufficient to permit direct rotation of said ring gear with rotation of said sun gear and said hub member until a predetermined brake-away force has been reached.

7. An ergonomic hand wheel assembly for use on a hand brake system disposed on a railway car, according to claim 6, in which said brake-away means comprises a thermoset laminate and wave spring.

8. An ergonomic hand wheel assembly for use on a hand brake system disposed on a railway car, according to claim 1, in which said sun gear is directly attached to a rotatable sun gear mounting plate disposed between said sun gear and said hand manipulation member.

9. An ergonomic hand wheel assembly for use on a hand brake system disposed on a railway car, according to claim 8, in which a spacer member is rigidly disposed between said sun gear mounting plate and said hand manipulation member.

10. An ergonomic hand wheel assembly for use on a hand brake system disposed on a railway car, said ergonomic hand wheel assembly comprising:

(a) a front housing assembly including;

(i) a generally concave front housing disk having a peripheral flange, (ii) a rotatable sun gear adjacent to a concave inside surface of said generally concave front housing disk, and (ii) a hand manipulation member adjacent an outer surface of said generally concave front housing disk rigidly connected to said sun gear such that rotation of said hand manipulation member relative to said front housing disk will cause an equal rotation of said sun gear about an axis of rotation;

(b) a back housing assembly including;

(i) a generally concave back housing disk having a peripheral flange, (ii) a rotatable hub member adjacent a concave inside surface of said generally concave back housing disk having an axis of rotation aligned with said axis of rotation of said sun gear and said hand manipulation member, and such that said rotatable hub member is independently rotatable relative to said hand manipulation member and said sun gear about said axis of rotation, said hub member having a means extending through said generally concave back housing disk disposed at said axis of rotation for attaching said hub member to a rotatable hand brake drive shaft of such hand brake system disposed on such railway car; and (iii) a plurality of planetary gears, one each of said plurality of planetary gears rotatably mounted onto one of a plurality of gear axles, said gear axles attached to said hub member and aligned, parallel and substantially equally spaced from said axis of rotation such that said planetary gears lie in a single plane and are substantially uniformly spaced around said sun gear, and adapted to mesh with and engage said sun gear such that rotation of said sun gear will cause rotation of said planetary gears on said gear axles;

(c) a stationary and generally flat internal housing disk including;

(i) a ring gear rigidly and axially secured therein, said ring gear having a circular race on an inside surface thereof adapted to encircle, engage and mesh with said plurality of planetary gears, and (ii) means extending from the periphery of said internal housing disk for attaching said internal housing disk to a structural element independent of said hand manipulation member and said hub member, such that said hand manipulation member and said hub member are independently rotatable relative to said internal housing disk; and (d) a brake-away means disposed intermediate said ring rear and said front housing assembly sufficient to permit rotation of said ring gear with rotation of said sun gear until a predetermined brake-way force has been reached, and (e) means for rigidly joining said generally concave front housing disk to said generally concave back housing disk at their peripheral flanges such that said generally flat internal housing disk is sandwitched therebetween.

11. An ergonomic hand wheel assembly for use on a hand brake system disposed on a railway car, according to claim 10, in which said brake-away means comprises a thermoset laminate and wave spring interposed between said ring gear and said stationary ring gear mounting plate.

12. An ergonomic hand wheel assembly for use on a hand brake system disposed on a railway car, according to claim 10, in which said hand manipulation member comprises an elongated lever arm manually pivotal about said axis of rotation.

13. An ergonomic hand wheel assembly for use on a hand brake system disposed on a railway car, according to claim 12, in which said elongated lever arm includes a ratchet means sufficient to cause rotation of said sun gear assembly as a result of a reciprocal pumping action applied to said elongated lever arm.

14. An ergonomic hand wheel assembly for use on hand brake system disposed on a railway car, according to claim 10, in which aligned apertures are provided through said sun gear assembly mounting plate, said hub mounting plate and said ring gear mounting plate to permit joining said hub mounting plate to said sun gear assembly mounting plate with said ring gear mounting plate sandwitched therebetween.

15. An ergonomic hand wheel assembly for use one hand brake system disposed on a railway car, according to claim 10, in which said sun gear assembly mounting plate and further serves as said ring gear mounting plate.

16. An ergonomic hand wheel assembly for use on a hand brake system disposed on a railway car, according to claim 10, in which said brake-away means comprises a thermoset laminate and wave spring.

17. An ergonomic hand wheel assembly for use on a hand brake system disposed on a railway car, according to claim 10, in which said sun gear is directly attached to a rotatable sun gear mounting plate disposed between said sun gear and said hand manipulation member.

18. An ergonomic hand wheel assembly for use on a hand brake system disposed on a railway car, according to claim 17, in which a spacer member is rigidly disposed between said sun gear mounting plate and said hand manipulation member.

* * * * *